United States Patent [19]

Stumpp et al.

[11] Patent Number: 4,667,633

[45] Date of Patent: May 26, 1987

[54] CORRECTING ARRANGEMENT FOR A FUEL METERING APPARATUS OF AN INTERNAL COMBUSTION ENGINE

[75] Inventors: Gerhard Stumpp, Stuttgart; Wolf Wessel, Oberriexingen, both of Fed. Rep. of Germany

[73] Assignee: Robert Bosch GmbH, Stuttgart, Fed. Rep. of Germany

[21] Appl. No.: 670,823

[22] Filed: Nov. 13, 1984

[30] Foreign Application Priority Data

Dec. 1, 1983 [DE] Fed. Rep. of Germany ..... 3343481

[51] Int. Cl.[4] ..... F02M 39/00

[52] U.S. Cl. ..... 123/357; 123/494; 73/119 A

[58] Field of Search ..... 123/358, 357, 359, 458, 123/494; 73/119 A

[56] References Cited

U.S. PATENT DOCUMENTS 4,372,266 2/1983 Hiyama ..... 123/357
4,395,905 8/1983 Fujimori ..... 123/357
4,417,554 11/1983 Dinger ..... 123/357
4,494,507 1/1985 Yashuhara ..... 123/357
4,503,820 3/1985 Nakagawa ..... 125/357

*Primary Examiner*—Carl Stuart Miller
*Attorney, Agent, or Firm*—Walter Ottesen

[57] ABSTRACT

The invention is directed to a correcting arrangement for a fuel metering apparatus of an internal combustion engine by means of which permanent offsets of the positioning control loop of the fuel metering apparatus of the internal combustion engine are corrected. This is accomplished in that at a specific load condition of the internal combustion engine, preferably in the overrun mode of operation subsequent to the idle speed control characteristic, the actually injected fuel quantity which is a diesel engine, for example, is preferably measured by means of the movement of the nozzle needle of the injection valve of the fuel metering apparatus, is checked to a known value, in the example cited preferably for zero value, and in that the result of this check is used to influence the control system of the fuel metering apparatus of the internal combustion engine.

5 Claims, 4 Drawing Figures

FIG. 1
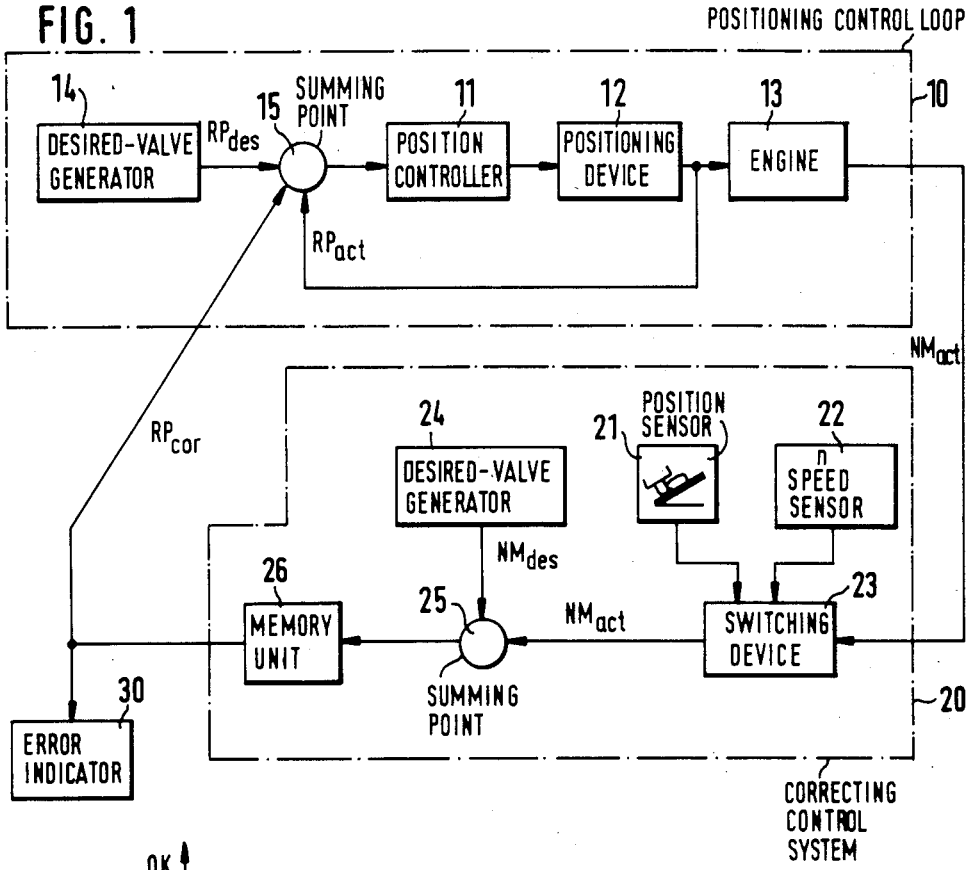
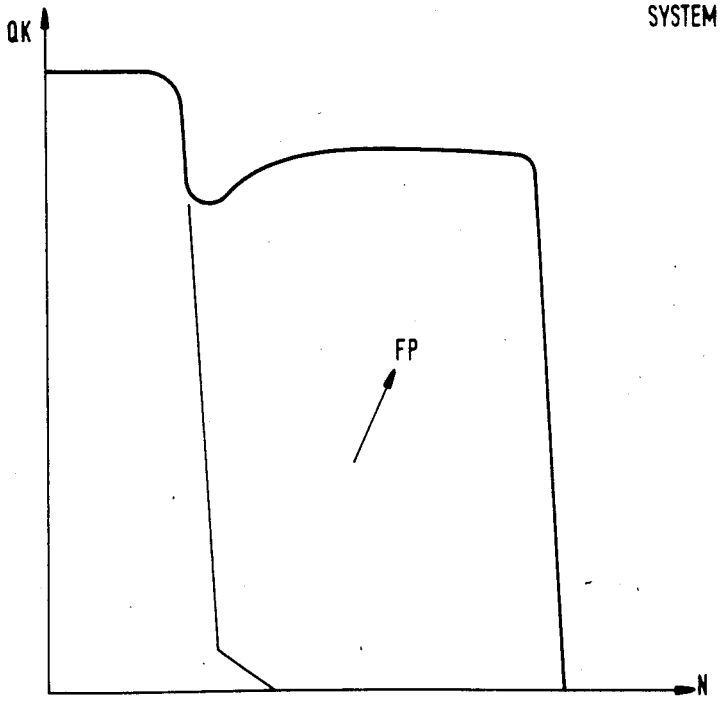
FIG. 2

CORRECTING ARRANGEMENT FOR A FUEL METERING APPARATUS OF AN INTERNAL COMBUSTION ENGINE

FIELD OF THE INVENTION

The invention relates to a correcting arrangement for a fuel metering apparatus of an internal combustion engine. The correcting arrangement detects and corrects changes in fuel metering that result from use and wear.

BACKGROUND OF THE INVENTION

In known fuel metering apparatus, the amount of fuel to be metered to the internal combustion engine is controlled in dependence on operating characteristics such as load, rotational speed and/or temperature of the internal combustion engine. Further, it is known to extend these control systems such that quantities characteristic of the amount of fuel actually injected into the internal combustion engine are utilized for the control of the fuel metering apparatus. For this purpose, for example, a signal indicative of the position of the rack is formed and used as the characterizing quantity of the amount of fuel actually injected. Now it may happen that, as a result of age and/or other phenomena, this characterizing quantity no longer corresponds to the amount of fuel actually injected into the internal combustion engine. Thus the control system determining the amount of fuel to be metered may be disturbed, for example, as a result of: wear of the pump drive and/or the quantity controlling unit; changes of the rack position sensor; compressibility and/or viscosity of the fuel; and, temperature-dependent changes of one or several components of the fuel metering apparatus. Consequently, the fact that it is not the amount of fuel actually injected but instead only a quantity characteristic of this amount that is measured, and further that the exact relationship between these two quantities is not known at any time, are the reasons why fuel metering to the internal combustion engine may be subject to permanent errors.

SUMMARY OF THE INVENTION

The correcting arrangement of the invention for a fuel metering apparatus of an internal combustion engine affords the advantage of permitting the detection and correction of changes in fuel metering that result from age. This is accomplished by measuring the actually injected amount of fuel at a specific load and by correcting the desired amount of fuel to be injected independently of the actual control system determining the amount of fuel to be metered.

Advantageous improvements of the correcting arrangement of the invention will become apparent from the following description of embodiments in conjunction with the drawing and from the claims.

BRIEF DESCRIPTION OF THE DRAWING

The invention will now be described in more detail in the following with reference to the drawing wherein:

FIG. 1 is a block diagram of a correcting arrangement for a fuel metering apparatus;

FIG. 2 is a characteristic showing injected fuel quantity plotted as a function of rotational speed and accelerator pedal position; and, FIGS. 3 and 4 are views of portions of the characteristic of FIG. 2.

DESCRIPTION OF THE PREFERRED EMBODIMENTS OF THE INVENTION

Figure 3:
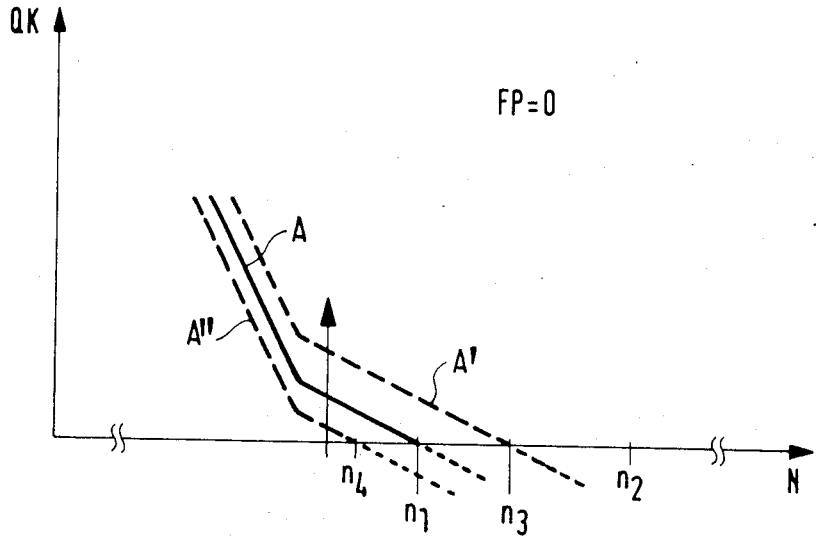

The block diagram of FIG. 1 includes an internal combustion engine, a fuel metering apparatus and a correcting arrangement for the fuel metering apparatus. The positioning control loop 10 is made up of a position controller 11, a positioning device 12, an internal combustion engine 13, a first desired-value generator 14 and a summing point 15. Summing point 15, position controller 11, positioning device 12 and internal combustion engine 13 are connected in series. The output signal of positioning device 12, that is $RP_{act}$, is supplied to summing point 15. The output signal of first desired-value generator 14, that is $RP_{des}$, is likewise supplied to summing point 15.

Further, the block diagram of FIG. 1 shows a correcting control system 20 including an accelerator pedal position sensor 21, a rotational speed sensor 22, a switching device 23, a second desired-value generator 24, a summing point 25 and a control and memory unit 26. A signal $NM_{act}$ coming from internal combustion engine 13 is applied to the input of switching device 23. The output of switching device 23 goes to summing point 25. Switching device 23 is controlled by accelerator pedal position sensor 21 and rotational speed sensor 22. The output signal $NM_{des}$ of the second desired-value generator 24 is connected to summing point 25. The output signal of summing point 25 is applied to control and memory unit 26 whose output signal $RP_{cor}$ is applied to summing point 15. Further, the output signal of control and memory unit 26 is also used for controlling an error indicator 30.

In the present embodiment, the internal combustion engine is a diesel engine.

It is the purpose of positioning control loop 10 to cause a quantity of the positioning device 12 to follow a desired value with the greatest possible precision. For example, in a special case, the actual value of rack position $RP_{act}$ should follow the desired value $RP_{des}$. The mode of operation of such an actuating control system is known and will not be described here in more detail.

The purpose of correcting control system 20 is to form a signal by means of which permanent offsets of positioning control loop 10 are corrected. For this purpose, correcting control system 20 receives a signal indicative of, for example, the actual needle movement $NB_{act}$ which permits detection of the permanent offset of positioning control system 10. From this input signal, correcting control system 20 forms an output signal, for example, a correcting rack position $RP_{cor}$ which is then applied to positioning control loop 10.

The fuel is metered to the internal combustion engine by means of an injection pump, with the amount of fuel to be injected being adjusted with a control rack. A sensor senses the position of the rack so that in this way the positioning control loop of the block diagram of FIG. 1 is brought about including the desired value and the actual value of the rack position. However, the quantity that is of relevance in the metering of fuel to the diesel engine described herein is not the position of the rack; rather, it is the amount of fuel actually injected. In theory, there is a defined relationship between rack position and the amount of fuel injected. In practice, however, this relationship depends on a plurality of factors such as the operating temperature of the internal combustion engine, the composition of the fuel, wear of the mechanical components of the fuel metering apparatus, drifts of the rack position sensor, et cetera.

Positioning control loop 10 can only partially correct these factors which change the relationship between rack position and the amount of fuel injected. This situation is present because, for example, wear of the mechanical components of the fuel injection pump does not affect the rack position; however, it may result in permanent changes in the quantity of the injected fuel. This permanent offset is corrected by means of correcting control system 20 which forms a signal $RP_{cor}$ indicative of the correcting rack position. This signal has precisely the value necessary, for example, to compensate for the wear of mechanical components of the injection pump and thereby cancel the permanent offset of positioning control loop 10.

The mode of operation of correcting control system 20 shall now be explained with reference to FIGS. 2, 3 and 4.

FIG. 2 shows the characteristic of the quantity QK of injected fuel as a function of rotational speed N and accelerator pedal position. In FIG. 2, the rotational speed N of the internal combustion engine is indicated along the abscissa, and the injected fuel quantity QK is indicated along the ordinate. As can be seen from FIG. 2, in addition to being dependent on rotational speed N, the injected fuel quantity QK is also dependent on accelerator position FP. FIGS. 3 and 4 show specific portions of the characteristic of FIG. 2 with the accelerator pedal in the position FP=0.

As mentioned in the foregoing, a signal has to be supplied to correcting control system 20 by means of which the permanent offset conditions of positioning control loop 10 can be detected. In the embodiment described, this signal is the actual movement $NM_{act}$ of the nozzle needle. Between this actual needle movement $NM_{act}$ and the quantity of fuel QK actually injected there exists a defined relationship which can be changed by the effects of temperature, time and/or other factors to only an insignificant extent. To detect a permanent offset condition of positioning control loop 10, a specific load condition of the internal combustion engine is selected for which the quantity of fuel to be injected is known. When this load condition occurs, correcting control system 20 will check whether the quantity of fuel actually injected corresponds to this known quantity and, if necessary, it will correct positioning control loop 10 by means of signal $RP_{cor}$.

It will be particularly advantageous to select the specific load condition such that at this load condition, a transition from a fuel quantity unequal to zero to a fuel quantity equal to zero occurs, or vice versa. In this embodiment, therefore, signal $NM_{act}$ is in a state of switching from $NM_{act} \neq 0$ to $NM_{act}=0$, or vice versa.

Figure 4:
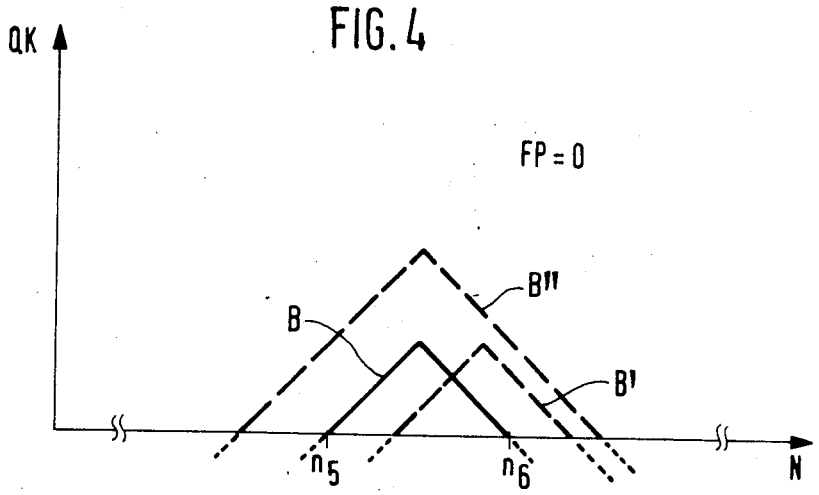

The specific load chosen is preferably in the overrun mode of operation with the accelerator pedal in position FP=0 and covering a rotational speed in the range of $n_1 < N < n_2$ as illustrated in FIG. 3. The occurrence of this load is sensed by switching device 23 receiving accelerator pedal position signal FP from accelerator pedal position sensor 21 and rotational speed signal N from rotational speed sensor 22. At the specific load chosen, that is, with FP=0 and $n_1 < N < n_2$, the circuit of switching device 23 will close, transmitting signal $NM_{act}$ to summing point 25. There, this signal is combined with a reference value $NM_{des}$ generated by the second desired-value generator. The result of this operation at summing point 25 is applied to control and memory unit 26 which produces the correcting signal $RP_{cor}$ already referred to above.

The generation of this correcting signal $RP_{cor}$ shall now be explained with reference to FIG. 3. As is known, with the accelerator pedal in position FP=0 and the rotational speed in the range $n_1 < N < n_2$, the amount of fuel to be injected into the internal combustion engine must be zero. The idle speed control of the internal combustion engine will not take over until the rotational speed is less than $n_1$ and fuel will again be injected. This is illustrated in characteristic A of FIG. 3.

If, as a result of the permanent offset of positioning control loop 10, characteristic A has shifted towards characteristic A' additively, for example, then fuel will be injected for idle speed control already within the rotational speed range $n_1 < N < n_2$ at rotational speed $n_3$ (FIG. 3). The fact that fuel is injected is recognized by the needle movement $NM_{act}$ and transmitted, via the closed circuit of switching device 23, to control and memory unit 26 which then forms the above-mentioned correcting value in dependence upon this input signal. By means of this correcting value, characteristic A' then is shifted in the direction of characteristic A. As explained in the foregoing, the relationship between needle movement and injected fuel quantity may be subject to certain changes in practice. However, to avoid that these changes affect correcting control system 20, needle movement $NM_{act}$ is not regulated to zero which theoretically corresponds to fuel quantity QK=0 at the specific load of the internal combustion engine; instead, the needle movement $NM_{act}$ is regulated to a desired value $NM_{des}$ which corresponds to an assumed maximum change in the relationship between needle movement and injected fuel quantity. To prevent a correcting value $RP_{cor}$ from becoming lost once it is obtained, the function of control and memory unit 26 is not only to form this correcting value but also to store the correcting value directly when it is formed. Thus, for example, control and memory unit 26 may include a proportional controller or a PI controller, followed by a summing memory store.

Up to now, the arrangement described could only detect shifts of characteristic A towards higher rotational speeds. However, if characteristic A experiences a shift towards characteristic A", control and memory unit 26 will not generate a correcting value $RP_{cor}$ since at rotational speed $n_1$, the injected fuel quantity is equal to zero. Therefore, it is particularly advantageous to configure control and memory unit 26 as a counter with a memory store connected to its output. If the amount of fuel injected at rotational speed $n_1$ is equal to zero, the counter is decremented, for example; whereas, an injected fuel quantity greater than zero results in the counter being incremented. If, in the embodiment described, characteristic A has shifted towards characteristic A", for example, the counter of control and memory unit 26 will decrement correcting value $RP_{cor}$ until the permanent offset of characteristic A is corrected. In this embodiment, the memory store connected to the output of the counter serves to store the instantaneous count and thus also the actual correcting value. If an offset of characteristic A is corrected by control and memory unit 26, the correcting value will always alternate between two successive counts.

In lieu of correcting the permanent offset of characteristic A step by step by means of decrementing or incrementing, it is also possible to determine correcting value $RP_{cor}$ directly from the rotational speed difference $(n_3-n_1)$ or $(n_4-n_1)$ and from the known slope of characteristic A.

As already mentioned above, characteristic A illustrated in FIG. 3 is the idle speed control characteristic. Such a characteristic may also be obtained by means of the first desired-value generator 14 in any section of the speed range that is above rotational speed $n_1$. In this connection, it will be particularly advantageous to generate a characteristic that intersects the abscissa at two points. This is illustrated in FIG. 4 wherein the characteristic generated in this particular embodiment forms a triangle B intersecting the abscissa at rotational speeds $n_5$ and $n_6$. A shift of triangle B towards higher rotational speeds as illustrated by triangle B', for example, can then be detected just as a shift of triangle B towards a greater amount of injected fuel as shown by triangle B''. The introduction of the triangle function B not only makes it possible to establish a permanent offset condition of positioning control loop 10 as can also be determined by means of characteristic A, but also affords the added possibility of determining the type of permanent offset, that is, whether a speed-dependent or a quantity-dependent change is involved. The triangle function then enables control and memory unit 26 to respond to permanent offsets of positioning control loop 10 still better by executing the corrections separately, for example, in the direction of the abscissa or the ordinate.

Special error indicator 30 performs a continuous check on the output signal of control and memory unit 26. If this signal exceeds a specific predeterminable value, error indicator 30 signals this condition to the vehicle operator and/or acts upon the internal combustion engine in some other manner. The purpose of error indicator 30 is to avoid a situation wherein permanent offsets of positioning control unit 10 which correcting control system 20 cannot correct result for example in: damage to the internal combustion engine; excessive fuel consumption; or, pollutant emissions.

It is possible to modify the configuration of correcting control system 20 without changing its basic function. Thus, for example, second desired-value generator 24 may be connected to switching device 23 instead of to summing point 25, so that the circuit of switching device 23 is not closed until the actual needle movement $NM_{act}$ is greater than desired travel $NM_{des}$. Signal $NM_{act}$ which is transmitted with the switch circuit closed is then regulated down to zero by control and memory unit 26. Further, control and memory unit 26 may also be split into a controller and a memory store, and the controller may be arranged ahead of switching device 23 in the block diagram.

While the embodiment described relates to a diesel engine, the correcting arrangement described is also suitable for use in connection with a gasoline engine. In a diesel engine, the signal indicative of the actual amount of fuel injected can be obtained by means of a needle stroke sensor as described, for example, in German published patent application DE-OS No. 30 32 361. In a gasoline engine, the corresponding signal can be generated by means of a solenoid-operated control device as disclosed, for example, in published German patent application DE-OS No. 22 51 472.

It is also possible to execute the block diagram of FIG. 1 not only by means of an analog circuit configuration but also by means of a suitably programmed microprocessor.

All these possibilities have one common feature which is the essence of the invention. It is the fact that at a specific load the zero passages of a characteristic are sensed, compared with known values, and that in dependence on the result of this comparison, a correcting value is formed by means of which the zero passages of the characteristic can be influenced.

It is understood that the foregoing description is that of the preferred embodiments of the invention and that various changes and modifications may be made thereto without departing from the spirit and scope of the invention as defined in the appended claims.

What is claimed is:

1. A correcting arrangement for a fuel metering apparatus of an internal combustion engine comprising:

a control loop for determining the quantity of fuel to be injected;

a plurality of sensors for measuring respective variable quantities of the internal combustion engine indicative of the operating condition of the latter;

measuring means for measuring the actual quantity of fuel injected;

control and storage means for influencing said control loop in dependence upon said actual quantity of fuel injected in a predetermined operating condition of said engine;

said control and storage means including control means for forming an output signal with each occurrence of said predetermined operating condition; and, storage means for temporarily storing said output signal until the next occurrence of said predetermined operating condition;

said control and storage means forming correcting signals for influencing said control loop in dependence upon said actual quantity of fuel injected in a predeterminined operating condition of said engine; and, said storage means including means for adding said output signal to the immediately previously occurring one of said correcting signals and for storing the result of said addition as a ready correcting signal for influencing said control loop.

2. A correcting arrangement for a fuel metering apparatus of an internal combustion engine comprising:

a control loop for determining the quantity of fuel to be injected;

a plurality of sensors for measuring respective variable quantities of the internal combustion engine indicative of the operating condition of the latter;

measuring means for measuring the actual quantity of fuel injected;

control and storage means for influencing said control loop in dependence upon said actual quantity of fuel injected in a predetermined operating condition of said engine;

said measuring means including means for forming an actual-valve signal indicative of the actual quantity of fuel injected;

a desired-value generator for generating a desired-value signal indicative of the desired quantity of fuel to be injected;

said control and storage means including combining means for combining said actual-value signal with said desired-value signal; and, switch means connected ahead of said combining means and said control and storage means, said switch means being configured to monitor the output signals of said plurality of sensors and to pass said actual-value signal to said combining means when said predetermined operating condition occurs.

3. A correcting arrangement for a fuel metering apparatus of an internal combustion engine comprising:

a control loop for determining the quantity of fuel to be injected;

a plurality of sensors for measuring respective variable quantities of the internal combustion engine indicative of the operating condition of the latter;

measuring means for measuring the actual quantity of fuel injected;

control and storage means for influencing said control loop in dependence upon said actual quantity of fuel injected in a predetermined operating condition of said engine;

said control and storage means including control means for forming an output signal with each occurrence of said predetermined operating condition; and, storage means for temporarily storing said output signal until the next occurrence of said predetermined operating condition;

said control and storage means forming a correcting signal for influencing said control loop in dependence upon said actual quantity of fuel injected in a predetermined operating condition of said engine; and, error indicating means for performing a check of said correcting signal and for determining when said signal exceeds a specific predetermined limit value, said error indicating means including means for indicating to the driver when said correcting signal exceeds said predetermined limit value.

4. A correcting arrangement for a fuel metering apparatus of an internal combustion engine comprising:

a control loop for determining the quantity of fuel to be injected;

a plurality of sensors for measuring respective variable quantities of the internal combustion engine indicative of the operating condition of the latter;

measuring means for measuring the actual quantity of fuel injected;

control and storage means for influencing said control loop in dependence upon said actual quantity of fuel injected in a predetermined operating condition of said engine;

said control and storage means including control means for forming an output signal with each occurrence of said predetermined operating condition; and, storage means for temporarily storing said output signal until the next occurrence of said predetermined operating condition;

said control and storage means forming a correcting signal for influencing said control loop in dependence upon said actual quantity of fuel injected in a predetermined operating condition of said engine; and, error indicating means for performing a check of said correcting signal and for determining when said signal exceeds a specific predetermined limit value, said error indicating means including means for influencing said engine when said correcting signal exceeds said predetermined limit value.

5. The correcting arrangement of claim 1, comprising switch means connected ahead of said combining means and said control and storage means, said switch means being configured to monitor the output signals of said plurality of sensors and to pass said actual-value signal to said combining means when said predetermined operating condition occurs.

* * * * *

UNITED STATES PATENT AND TRADEMARK OFFICE

CERTIFICATE OF CORRECTION

PATENT NO. : 4,667,633

DATED : May 26, 1987

INVENTOR(S) : Gerhard Stumpp and Wolf Wessel

It is certified that error appears in the above-identified patent and that said Letters Patent is hereby corrected as shown below:

In "Abstract, line 10: delete "is a diesel" and substitute -- in a diesel -- therefor.

In column 6, line 57: delete "valve" and substitute --value-- therefor.

Signed and Sealed this

Twenty-sixth Day of April, 1988

*Attest:*

DONALD J. QUIGG

*Attesting Officer*

*Commissioner of Patents and Trademarks*